US005480100A

United States Patent [19]

Tagawa et al.

[11] Patent Number: 5,480,100

[45] Date of Patent: Jan. 2, 1996

[54] APPARATUS FOR CRUSHING CONCRETE STRUCTURES

[75] Inventors: Itsuo Tagawa; Takaharu Kozaki, both of Tokyo, Japan

[73] Assignee: Tagawakougyou Co., Ltd., Tokyo, Japan

[21] Appl. No.: 129,053

[22] PCT Filed: Feb. 3, 1992

[86] PCT No.: PCT/JP92/00100

§ 371 Date: Dec. 2, 1993

§ 102(e) Date: Dec. 2, 1993

[87] PCT Pub. No.: WO93/15291

PCT Pub. Date: Aug. 5, 1993

[51] Int. Cl.[6] ..... B02C 1/08

[52] U.S. Cl. ..... 241/266; 241/101.73

[58] Field of Search ..... 92/52, 53, 66, 92/151, 152; 241/101.7, 263, 266

[56] References Cited

U.S. PATENT DOCUMENTS

| | | | |
|---|---|---|---|
| 2,933,070 | 4/1960 | Trümper et al. | 92/53 X |
| 4,227,850 | 10/1980 | Farmer et al. | 92/52 X |
| 4,296,679 | 10/1981 | Mattsson | 92/53 X |
| 4,523,512 | 6/1985 | Hessel et al. | 92/53 X |
| 5,199,658 | 4/1993 | Bartels et al. | 241/101.7 X |

FOREIGN PATENT DOCUMENTS

| | | |
|---|---|---|
| 2104502 | 8/1972 | Germany . |
| 63-40061 | 2/1988 | Japan . |

*Primary Examiner*—Timothy V. Eley

*Attorney, Agent, or Firm*—Lowe, Price, LeBlanc & Becker

[57] ABSTRACT

Disclosed is a crushing equipment for crushing a pillar or beam of concrete structures through opening and closing movement of a pair of arms while clamping the pillar or beam by a pair of crushing blades provided on the ends of the arms. A hydraulic cylinder 1 for opening and closing the arms comprises a second cylinder including a couple of cylinders 3' and 3", and a pair of first cylinders fitted into the cylinders 3' and 3", respectively, and each having a cylinder bottom serving as a piston 9. When a hydraulic oil is introduced through a fifth oil port 18 provided in the second cylinder on the side of the cylinder bottom, the first cylinders 2 are forwardly displaced. When the first cylinders 2 reach their stroke ends, pistons of the first cylinders are forwardly moved to close the arms for crushing the concrete structure. When the hydraulic oil is introduced through fourth oil ports 16, the pistons 5 are retracted by way of second oil ports 10 and oil passages 11. When the pistons 5 reach their stroke ends, the pressure of the hydraulic oil acts on the cylinder bottoms of the first cylinders by way of gaps retracting the first cylinders to open the arms. The hydraulic oil is into the hydraulic cylinder 1 supplied only through the fourth oil ports 16 and the fifth oil port 18, thereby simplifying control operation.

4 Claims, 3 Drawing Sheets

APPARATUS FOR CRUSHING CONCRETE STRUCTURES

TECHNICAL FIELD

The present invention relates to a crushing apparatus for crushing concrete structures by opening and closing arms.

BACKGROUND ART

A known a crushing apparatus for crushing concrete pillars or beams by opening and closing a pair of arms having crushing blades attached to the ends thereof. In crushing concrete structures using such type of crushing equipment, the ends of the arms must be widely opened when the concrete pillars or beams to be destroyed have a large diameter. Furthermore, in order to crush pillars or beams of such large diameter, a large crushing force is required because of such large diameter. However, once the pillars or beams are cracked first crushed, they can be crushed thereafter completely without requiring a force as large as the initial force.

On the other hand, the pillars or beams having a relatively small diameter for which the ends of the arms are not required to be widely opened do not require a large crushing force.

As a drive source for opening and closing the arms, that is, as a drive source for conferring a crushing force onto the crushing blades attached to the arms, normally a hydraulic cylinder is used. When using a hydraulic cylinder, it is necessary for the piston to have a large pressure-receiving area in order to produce a larger crushing force. However, the increase in the pressure-receiving area of the piston entails a reduction in the moving speed of the piston rod, that is, the reduction in opening and closing speed of the arms, which reduces the crushing operation efficiency. The concrete structures comprise pillars and beams range from large to small-diameter. There is no need for a large crushing force to be applied to pillars or beams of larger diameter once they have been crushed and cracked. Nevertheless, in order to crush pillars or beams of large-diameter, a hydraulic cylinder fitted with a piston having a large pressure-receiving area must used as a drive source for opening and closing the arms of the hydraulic cylinder. Thus, the same hydraulic cylinder must be used for crushing pillars or beams of small-diameter or the once crushed cracked pillars or beams, thereby reducing the efficiency of the crushing operation.

In order to solve the above problems, applicant invented an apparatus for crushing concrete structures using a telescopic hydraulic cylinder as a drive source for opening and closing the arms of the crushing apparatus, and has filed a patent application in Japan. The content of this invention is disclosed in Japanese Patent Laid-open Publication No. 63-40061.

The telescopic cylinder comprises a plurality of hydraulic cylinders, each cylinder including an oil port for the backward stroke provided in the outer periphery of the cylinder and communicating with the end of the piston-rod-side oil chamber, and an oil port for the forward stroke provided in the cylinder bottom, whereby, the cylinders of respective stages are reciprocated by supplying the hydraulic oil through the oil ports.

FIG. 4 illustrates a conventional telescopic hydraulic cylinder by way of example. This telescopic hydraulic cylinder comprises an outer cylinder 102 and a plurality of inner cylinders 101, each being fitted into another in sequence and having the above-described constitution. The cylinders are caused to be displaced forward by virtue of the hydraulic oil introduced through an oil port 103 provided in the cylinder bottom of the outer cylinder 102 in descending order according to the size of the cross-sectional area of cylinder bottom, thereby ensuring an initial high output and forwardly displacing the cylinders having a smaller sectional area in sequence in accordance with the extension of the stroke to speed up the protruding action in inverse proportion to the decrease in the output. Such output characteristics of the conventional cylinder are suitable for such hydraulic equipment as requiring a high output at initial drive and having a load decreasing in accordance with the increase in the extension of the stroke, for example, for a drive source for a load-carrying platform of a dump truck, or for a drive source for a crushing equipment for concrete structures or others. However, in the case of the crushing equipment for concrete structures or others on which a retractive force arising from the weight of the object to be driven will not act, there is a need for means for retracting the once extended hydraulic cylinder to its initial state. For the retracting action in the example shown in FIG. 4, the hydraulic oil introduced through an oil port 104 provided at the end of piston-rod-side oil chamber of the outer cylinder 102 is supplied into the piston-rod-side oil chambers of the respective cylinders by way of oil ports 105 provided in outer peripheries of the cylinder in the vicinity of the cylinder bottoms of the cylinders 101, oil passages 106 extending through the interior of the cylinders 101, and then oil ports 107 provided at the end of the piston-rod-side oil chamber. The retractable forces to be applied on the respective cylinders 101 depend on, for example, the relationship between the diameters of the cylinders and the diameters of the cylinder bottoms. More specifically, the retractive action of a cylinder of smaller diameter will not necessarily precede that of a cylinder having a larger diameter. In case a cylinder of larger diameter precedes a cylinder of smaller diameter in the retractive action, the subsequent protracting action will always starts from the cylinder of larger diameter, thereby disabling the high-speed retractable action at the top of the extended stroke.

Accordingly, in order to realize the superior characteristics of the telescopic hydraulic cylinder such that not only initial high output is ensured but also a high-speed retractive action is possible in the extended state of stroke, it is always necessary that the retractable action be started from a cylinder of smaller diameter.

Thus, in view of this point, as disclosed in the Japanese Patent laid-open Publication No. 63-40061, the present applicant has developed a telescopic hydraulic cylinder in which there are provided oil ports separately communicating with the piston-rod-side oil chambers of the smaller-diameter cylinders, and with the piston-rod-side oil chamber of the larger-diameter cylinder receiving the smaller-diameter cylinders under the condition where the piston rods of the smaller-diameter cylinders are fully extended forward, and the hydraulic oil is supplied in sequence from the piston-rod-side oil chamber of a smaller-diameter cylinder to cause the retractive action to take place in sequence from a smaller-diameter cylinder. Simultaneously, the present applicant has also proposed a crushing equipment for concrete structures using such telescopic hydraulic cylinder as a drive source for opening and closing of the arms. The telescopic hydraulic cylinder disclosed in the Japanese Patent Laid-open Publication No. 63-40061, however, has a shortcoming such that the supply of the hydraulic oil into the piston-rod-side oil chambers of the respective cylinders must be controlled separately for the retractive actions, thereby complicating the opening and closing operation of arms.

DISCLOSURE OF THE INVENTION

An object of the present invention is to provide a crushing equipment for concrete structures capable of producing a large crushing force when largely opening the extremities of arms to crush the concrete structures and is also capable of increasing the opening and closing speed of the arms when the extremities of the arms are required to be opened only to a relatively small extent, thereby improving operating efficiency.

Another object of the present invention is to provide a crushing equipment for concrete structures featuring simplified operation and control of the opening and closing action of its arms.

In order to accomplish the above objects, according to an aspect of the present invention, a hydraulic cylinder for opening and closing the arms of the crushing equipment for concrete structures intended to crush the concrete structures comprises a first cylinder which receives therein a piston having a piston rod protruding in one direction, the first cylinder including a piston-rod-side oil chamber and a piston-side oil chamber in front of and behind the piston, respectively; and a second cylinder which receives therein the first cylinder whose cylinder bottom serves as a piston of the second cylinder, the second cylinder including a piston rod-side oil chamber and a piston-side oil chamber in front of and behind the cylinder bottom, respectively, of the first cylinder. The first cylinder has a first oil port opening in the end of the piston-rod-side oil chamber, a second oil port opening in the outer periphery of the cylinder bottom and communicating with the first oil port by way of an oil passage extending through the interior of the first cylinder, and a third oil port provided in the cylinder bottom. The second cylinder has a fourth oil port opening in the end of the piston-rod-side oil chamber, and a fifth oil port provided in its cylinder bottom. A passage having a predetermined flow resistance is formed between the second oil port and the piston-rod-side oil chamber of the second cylinder. The fourth oil port is allowed to confront the second oil port when the first cylinder reaches its stroke end on piston rod side.

According to another aspect of the present invention, the second oil port is provided in the vicinity of the cylinder bottom of the first cylinder instead of being provided in the outer periphery of the cylinder bottom thereof. The fourth oil port is allowed to confront the second oil port when the first cylinder reaches its stroke end on piston rod side. Confronting surfaces formed when the fourth oil port and the second oil port confront each other present a predetermined flow resistance, and define a passage opening into the piston-rod-side oil chamber of the second cylinder.

According to a further aspect of the present invention, there are provided two pairs of cylinders each consisting of the first cylinders and the second cylinders, and the couple of second cylinders are bottom-to-bottom joined together through an annular member so as to define the piston-side-oil chamber in each of the second cylinders, thus forming a double-rod type telescopic hydraulic cylinder.

In the present invention having the constitution described above, when the hydraulic oil is supplied through the fifth oil port provided in the cylinder bottom of the second cylinder to initiate the forward movement, it is allowed to flow into the piston-side oil chamber of the second cylinder. The hydraulic oil introduced into the piston-side oil chamber of the second cylinder acts not only to pressurize the cylinder bottom of the first cylinder in the forward direction but also to pressurize the piston fitted into the first cylinder in the forward direction by way of the third oil port provided in the cylinder bottom of the first cylinder. However, since the pressure-receiving area of the cylinder bottom of the first cylinder is larger than that of the piston, the first cylinder first initiates its forward movement. The cylinder bottom of the first cylinder is subjected to such a large pressure that the first cylinder receiving therein the piston is forced to protrude together with the piston, to thereby drive powerfully the arms of the crushing equipment to crush the pillars or beams of the concrete structures or others.

Then, when the first cylinder reaches its forward stroke end, that is, when the protruding action of the first cylinder is restricted, the hydraulic oil supplied from the fifth oil port is allowed to flow into the piston-side oil chamber of the first cylinder by way of the third oil port, to thereby force the piston having a smaller pressurized area and fitted into the first cylinder to protrude from the first cylinder at a high speed for the forward movement. In this case, although the crushing force is reduced, however, a large crushing force is not required to further crush once crushed cracked pillars or beams, Moreover, once crushed pillars or beams the can be broken at a higher speed.

When the supply of hydraulic oil through the fifth oil port is stopped but the supply thereof through the fourth oil port is started under the condition where the first cylinder has reached its forward stroke end, the hydraulic oil flows into the piston-rod-side oil chamber of the first cylinder by way of the second oil port facing the fourth oil port, the oil passage extending through the interior of the first cylinder, and the first oil port, thereby not only pressurizing the piston fitted into the first cylinder in the backward direction but also tending to flow into the piston-rod-side oil chamber of the second cylinder by way of the gap passage opening into the piston-rod-side oil chamber of the second cylinder. However, since the interior of this passage is subjected to the predetermined flow resistance under the condition where the second oil port confronts the fourth oil port, the hydraulic oil is first allowed to flow into the piston-rod-side oil chamber of the first cylinder by way of the second oil port having less flow resistance, thereby causing the piston having a smaller pressurized area and fitted into the first cylinder and to retract at a higher speed to open the arms of the crushing equipment at a high speed.

When the piston inserted into the first cylinder reaches its backward movement limit where the displacement of the piston is restricted, the pressure of the hydraulic oil supplied through the fourth oil port directly acts on the gap passage and overcomes the predetermined flow resistance to flow into the piston-rod-side oil chamber of the second cylinder. Thus, the cylinder bottom of the first cylinder is pressed in the backward direction by the pressure of the hydraulic oil to retract the first cylinder receiving therein the piston, which has arrived at its backward movement limit, together with the piston.

When the retraction of the first cylinder is initiated, the state where the second oil port confronts the fourth oil port is broken and the flow resistance of the passage is eliminated, so that the pressure of the hydraulic oil supplied through the fourth oil port directly acts on the cylinder bottom of the first cylinder to largely open the arms of the crushing equipment.

When crushing pillars or beams having a large diameter, the arms are largely opened and a large force is produced by the forward movement of the first cylinder to crush the pillars or beams with the aid of the crushing blades. For the pillars or beams having a large diameter which have been cracked once, or for the small-diameter pillars or beams, there is no need of a large force as is required usually. Therefore, in such situation, the piston of only the first cylinder is reciprocated to open or close the arms of the crushing equipment at a high speed with the first cylinder positioned at its forward stroke end, so that the crushing operation of the pillars on beams can be executed at a higher speed, thereby contributing to the improvement in the efficiency of crushing operation for the concrete structures.

Besides, since only the forth and firth oil ports are enough for supplying the hydraulic oil from the outside, the changeover of the hydraulic oil can be made easily, thereby also contributing to simplification of operation and control of the equipment.

BEST MODE FOR CARRYING OUT THE INVENTION

Figure 1:
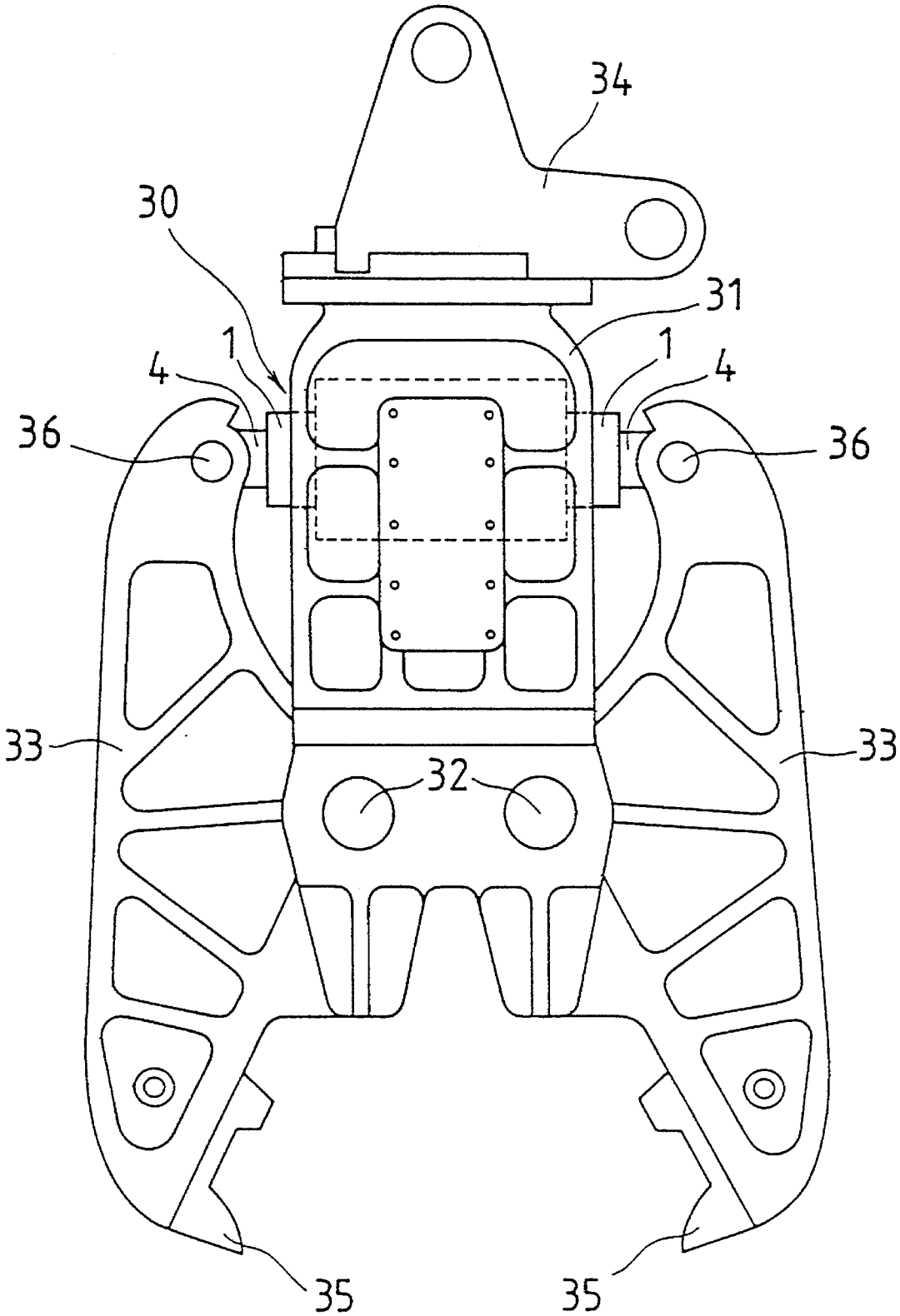
FIG. 1 is a top plan view of a crushing equipment for concrete structures on others which is an embodiment in accordance with the present invention.
Figure 2:
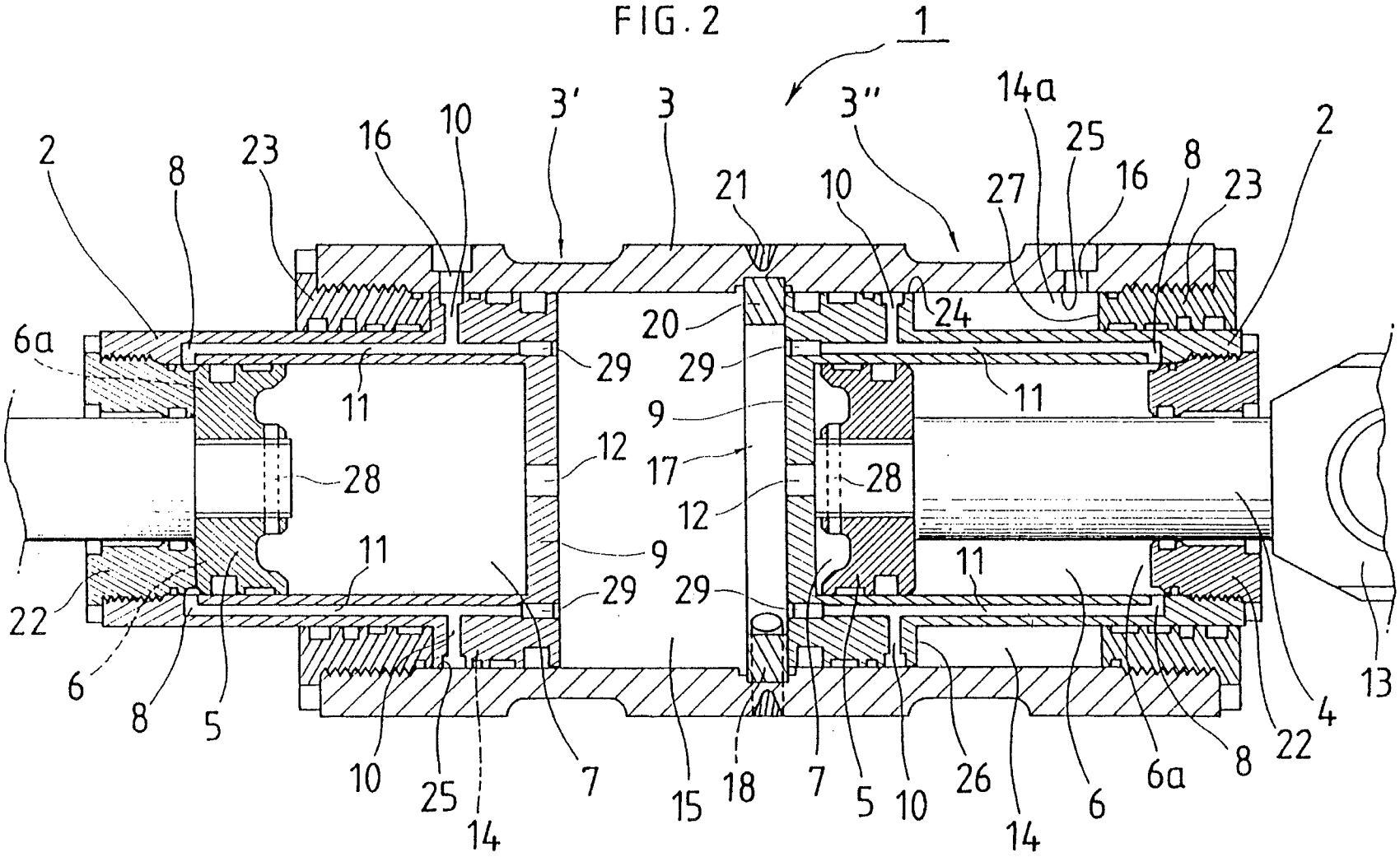
FIG. 2 is a sectional view showing a principal part of a telescopic hydraulic cylinder for use in the embodiment.

Referring to FIGS. 1 and 2, there is described a first embodiment an apparatus for crushing concrete structures in accordance with the present invention. The crushing apparatus 30 for concrete structures comprises a body 31 consisting of a couple of side plates disposed front and back spaced apart from each other at a given interval, a pair of arms 33 having respective crushing blades 35 confronting each other and rotatably mounted on the body 31 through respective pivots 32, a telescopic hydraulic cylinder 1, and an attachment 34 to be attached to a boom of an apparatus such as a power shovel. A clevis 13 is fixedly attached to the end of the piston rod 4. The clevis 13 has a through hole in which a pin 36 which is fixed to the arm 33 is rotatably inserted. The telescopic hydraulic cylinder 1 interposed between the couple of side plates has a pair of clevises 13 fitted through pins 36 to the side ends of the crushing blades 35 of the arms 33 in such a manner that the arms 33 are opened or closed through a piston rod 4 in the telescopic hydraulic cylinder 1. More specifically, the extension of the piston rod 4 of the hydraulic cylinder 1 causes the sides of arms 33 having the crushing blades 35 to be closed, whereas the retraction of the piston rod 4 causes the crushing blades 35 to be opened as shown in FIG. 1.

Referring next to FIG. 2, description will be given of the telescopic hydraulic cylinder 1 for use in this embodiment. In FIG. 2, the left half depicts a fully extended condition of the telescopic hydraulic cylinder 1 while the right, half depicts a fully retracted condition.

The telescopic hydraulic cylinder 1 is a double-rod type telescopic hydraulic cylinder comprising a pair of single-rod type hydraulic cylinders 3' and 3" whose cylinder bottoms are integrally joined together.

The telescopic hydraulic cylinder 1 comprises right and left first cylinders 2, and a second cylinder 3 including the hydraulic cylinders 3' and 3" whose bottoms are integrally joined together through a welded joint 21. The right and left first cylinders 2 have at their extremities the clevises 13 (only one is partially shown) and contain pistons 5 having piston Pods 4 each being extensible in one direction. A piston-rod-side oil chamber 6 and a piston-side oil chamber 7 are formed in front and in rear of the piston 5, respectively. First oil ports 8 opening at the ends **6*a* of the piston-rod-side oil chambers 6 of the first cylinders 2 communicate with second oil ports 10 opening into the outer peripheries of the cylinder bottoms 9 of the first cylinders 2 by way of oil passages 11 extending through the interior of the first cylinders 2. The cylinder bottoms 9 have at their substantial centers third oil ports 12. Reference numeral 29 denotes a tapered screw for pipes for filling drill holes forming the oil passages 11. The forward movements of the piston rods 4 with respect to the first cylinders 2 are restricted respectively by the inner end surfaces of cylinder heads 22 respectively screwed into the first cylinders 2. On the other hand, the backward movements of the piston rods 4 with respect to the first cylinders 2 are restricted respectively by the inner end surfaces of the cylinder bottoms 9. The positions of the inner end surfaces of the cylinder heads 22 substantially correspond, in the axial direction of the first cylinder 2, to the positions of the first oil ports 8 opening at the ends 6*a* of the piston-rod-side oil chambers of the first cylinder 2. Between the inner surfaces of the first cylinders 2 and the outer peripheries of the inner end surfaces of the cylinder heads 22 having slightly reduced diameters there are annular gaps to define the piston-rod-side oil chamber 6 at the limit of forward movement of the piston rods 4**.

The hydraulic cylinders 3' and 3" constituting the second cylinder 3 contain as their pistons the cylinder bottoms 9 of the first cylinders 2. Piston-rod-side oil chambers 14 and piston-side oil chambers 15 are respectively formed in front of and before the cylinder bottoms 9 of the first cylinder 2. In the vicinity of the ends **14*a* of the piston-rod-side oil chambers 14, the hydraulic cylinders 3' and 3" respectively have fourth oil ports 16 opening into the piston-Pod-side oil chamber 14. Furthermore, a fifth oil port 18 extends radially through an annular member 20 fastened to the inner periphery of a cylinder bottom 17 constituting a joint between the cylinders 3' and 3"**.

The forward movements of the first cylinders 2 with respect to the second cylinder 3 are restricted by inner end surfaces 27 of cylinder heads 23 screwed into the second cylinders 3. On the other hand, the backward movements of the first cylinders 2 with respect to the second cylinder 3 are restricted by the end surfaces of the annular member 20.

As shown in the left half of FIG. 2, when the first cylinder 2 has reached its forward stroke end, the second oil port 10 of the first cylinder 2 communicates with the fourth oil port 16 of the second cylinder 3. Between the second oil ports 10 and the piston-rod-side oil chambers 14 there are slight annular gaps radially extending from the inner peripheries 25 of the hydraulic cylinders 3' and 3" to the outer peripheries 24 of the cylinder bottoms 9. The annular gaps are so configured as to provide a predetermined flow resistance between the fourth oil ports 16 and the piston-rod-side oil chambers 14 of the second cylinder 3.

In FIG. 2, reference numeral 28 denotes split pins penetrated radially through the portions where the piston rods 4 are screwed into the pistons 5. The configurations, the positions of installation, etc. of sealing materials such as O-rings, packings, etc. are obvious to those skilled in the art, and hence the description thereof will be omitted.

The description will be made for the operation of the crushing equipment 30 for concrete structures or others having the constitution described above.

The crushing device 30 can be mounted on mobile equipment, such as a power shovel, by securing attachment means 34 to a extremity of the boom arm of such mobile equipment (not shown) with pins or other convention means. If the piston rods 4 and the first cylinders 2 are both positioned at their backward stroke ends as shown in the right half of FIG. 2, the pair of arms 33 are opened as shown in FIG. 1. When a hydraulic oil is supplied into the fifth port 18 while clamping pillars or beams of the concrete structure with the crushing blades 35, it flows into the respective piston-side oil chambers 15 of the second cylinder 3 partitioned by the annular member 20 to pressurize the cylinder bottoms 9 of the first cylinders 2 in the forward direction. Although the hydraulic oil which has entered the piston-side oil chamber 15 simultaneously pressurizes the cylinder by way of the third oil ports 12 provided in the cylinder bottom 9, the pressure-receiving areas of the cylinder bottoms 9 are larger than those of the pistons 5, so that the forward movements of the first cylinders 2 precedes those of the pistons 5 due to the pressure acting on the cylinder bottoms 9. The pressure-receiving area of cylinder bottom 9 is equal to difference between the area of the third oil port 12 and the sectional area of the cylinder bottom 9 normal to its axial direction. The pressure-receiving area of the piston 5 coincides with the sectional area of the piston 5 normal to its axial direction. If the value obtained by dividing the friction to be created between the first cylinder 2 and the second cylinder 3 by the pressure-receiving area of the cylinder bottom 9 is larger than the value obtained by dividing the friction to be created between the piston 5, piston rod 4 and the first cylinder 2 by the pressure-receiving area of the piston 5, however, the forward movement of the piston 5 and piston rod 4 may possibly precede the forward movement of the first cylinder 2 subject to the presence of a perfect no-load condition. Actually, however, the clevises 13 are subjected to a large reaction force under the condition where the pillars or beams are clamped by the crushing blades 35 secured to the extremities of the arms 33, and hence it is difficult to forwardly displace the piston rod 4 only by the force exerted on the pressurized surface of the piston 5. For this reason, the large pressure to be exerted on the cylinder bottoms 9 always permits forward movement of the first cylinders 2 to precede. Thus, a large force to act on the cylinder bottoms 9 is transmitted to the crushing blades 35 to crush the pillars, beams or the like by use of the large force. The hydraulic oil within the piston-rod-side chamber 14 is discharged through the fourth oil ports 16.

When front surface 26 of the cylinder bottom 9 abuts against the end surface 27 of the cylinder head 23, or when the first cylinder 2 has reached its forward stroke end, the second oil port 10 of the first cylinder 2 is allowed to face the fourth oil port 16 of the second cylinder 3 as shogun in the left half of FIG. 2. When the first cylinders 2 complete reached their forward stroke, hydraulic oil supplied through the fifth oil port 18 flows into the piston-side oil chambers 7 by way of the third oil ports 12 on the pressurized surfaces of the pistons 5, and continues to forwardly displace the pistons 5 and the piston rods 4 until the front surfaces of the pistons 5 abut the end surfaces of the cylinder heads 22 thereby restriction further forward displacement of pistons 5. Although pistons 5 respectively produce smaller forces due to their pressure-receiving areas being smaller than those of the cylinder bottoms 9, the forward movement speed of each of the pistons 5 and piston rods 4 is higher than that of the first cylinders 2. As a result, the crushing blades 35 can be closed at a high speed even with a small force. Incidentally, the hydraulic oil within the piston rod-side oil chambers 6 is drawn off through the first oil ports 8, the oil passages 11, the second oil ports 10, and then the fourth oil ports 16.

With the range of the stroke of the first cylinders which is restricted by the cylinder bottoms 9, the crushing blades 35 secured to the extremities of the arms 33 open wider, close slower and provide a larger crushing force. On the contrary, within the range of the stroke of the piston rods 4 which is restricted by the pistons 5, the crushing blades 35 open smaller, provides smaller crushing force, but close faster.

With the first cylinders 2 at respective ends of their forward movement strokes, when the supply of the hydraulic oil through the fifth oil port 18 is stopped, and the supply thereof through the fourth oil ports 16 is started, the hydraulic oil flows into the piston-rod-side oil chambers 6 of the first cylinders 2 by way of the second oil ports 10 confronting the fourth oil ports 16, the oil passages 11 extending through the interior of the first cylinders 2 and the first oil ports 8 to pressurize the pistons 5 fitted into the first cylinders 2 in the backward direction, thereby causing the pistons 5 having smaller pressure-receiving areas to retract at a high speed, and then allowing the arms 33 to be opened at a higher speed. In this case, the pressure-receiving area of the piston 5 is equal to the difference between the sectional area of the piston rod 4 normal to its axis and the sectional area of the piston 5 normal to the axis.

The hydraulic oil supplied through the fourth oil ports 16 tends to flow, via gap passages formed between the inner peripheries 25 of the cylinders 3' and 3" and the outer peripheries 24 of the cylinder bottoms 9 having the second oil ports 10, even into the piston-rod-side oil chambers 14 to be defined by the gap passages. However, since the piston rods 4 are loaded only with the arms 33, the pistons 5 can be displaced to cause the arms to be opened without largely raising the pressure of the hydraulic oil within the piston-side oil chamber 7 and the oil ports 10. For this reason, the first cylinders 2 will not retreat even though the front surfaces of the cylinder bottoms 9 undergo a pressure reduced by the flow resistance of the gap passages.

When the end surfaces of the pistons 5 abut against the cylinder bottoms 9, or when they have reached the backward movement limits to prevent the piston-rod-side chambers 6 from being expanded in volume, it becomes impossible for the hydraulic oil supplied through the fourth oil port 16 to flow into the piston-rod-side oil chambers 6. As a result, the hydraulic oil increases its pressure, and flows into the piston-rod-side oil chambers 14 of the second cylinder 3 against the flow resistance which has been preset for the gap passages defined between the outer peripheries 24 of the first cylinder bottoms 9 and the inner peripheries 25 of the cylinders 3' and 3", thereby increasing the pressure of the hydraulic oil within the piston-rod-side oil chambers 14. This pressure of the hydraulic oil is applied to the pressure-receiving front surfaces 26 of the cylinder bottoms 9 to initiate the backward movements of the first cylinders 2 containing the pistons 5 positioned at their retraction limits. If a force large enough to initiate backward movement of first cylinders 2 cannot be obtained, partial protrusions can be provided on the end surfaces 27 of cylinder heads 23 or front surfaces 26 of the cylinder bottoms 9, such as, on the end surfaces of the outer peripheral sides, thereby forming gaps between the end surfaces 27 of the cylinder heads 23 and the front surfaces 26 of the cylinder bottoms 9 to increase the pressure-receiving area at the forward stroke ends, thereby enabling the initiation of the backward movements of the first cylinders 2.

When the first cylinders 2 are retracted to their predetermined positions so that the fourth oil ports 16 are allowed to directly communicate with the piston-rod-side oil chambers 14 of the second cylinder 3, the hydraulic oil presses the surfaces formed by the entire front surfaces 26 of the cylinder bottoms 9 to move backward the first cylinders 2 with a large force.

As is understandable from the above description of the operation, in order to crush a large mass of concrete pillars or beams, the telescopic hydraulic cylinders 1 have to be retracted to largely separate the crushing blades 35 before clamping the concrete mass or the like by the crushing blades 35 of the arms 33. Then, within a range extending from the initial positions where the first cylinders are entirely retracted to the forward stroke ends, where a low speed/high power drive force is generated, a powerful crushing force enough to destroy the concrete mass of pillars, beams or others is produced.

On the other hand, once cracked and weakened concrete of pillars or beams do not require a crushing force as large as that required at the beginning of the crushing operation. Therefore, after the first cylinders 2 at the forward stroke ends, it becomes possible for the arms 33 to be closed with a high speed/low power drive force, which eventually result in an improvement in the operating efficiencies.

On the contrary, when crushing a small-diameter mass of concrete pillars or beams, there is no need of largely separating the crushing blades 35 from each other. More specifically, arms 33 (with crushing blades 35) are opened and closed with the first cylinders 2 positioned at their forward stroke ends (as shown in the left half of FIG. 2) and with the distance between the crushing blades 35 kept shorter. When the first cylinders 2 are positioned at their forward stroke ends, only the pistons 5 are allowed to be displaced by virtue of the hydraulic oil deriving from the fourth and fifth oil ports. Accordingly, not only the arms 33 are allowed to be opened and closed to a smaller extent at a higher speed but also the crushing force to be generated can be smaller, and this will not cause any problem, because of the small diameters of the pillars or beams to be destroyed. To summarize, when the pillars or beams to be crushed have larger diameters, the opening and closing of the arms can be carried out at a lower speed but with a large crushing force to crush the pillars or beams. On the contrary, once cracked pillars or beams, or pillars or beams having small diameters, can be crushed even when the arms are opened and closed at a higher speed with a smaller crushing force, thereby enabling an improvement in operating efficiency.

In addition, since hydraulic oil is supplied only to fourth and fifth oil ports 16 and 18 of telescopic hydraulic cylinder 1, only a pair of hydraulic oil pipes need to be connected to the oil ports 16 and 18. Furthermore, control of the hydraulic oil is required only during the changeover between the forward movement and the backward movement of the telescopic hydraulic cylinder 1, thereby simplifying the operation.

Figure 3:
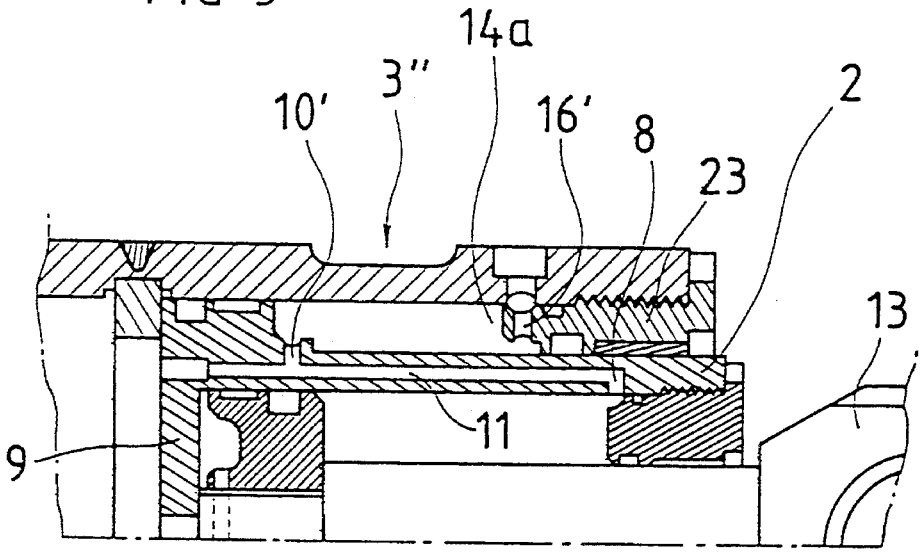
FIG. 3 is a sectional view showing a principal part of another embodiment of the present invention.
Figure 4:
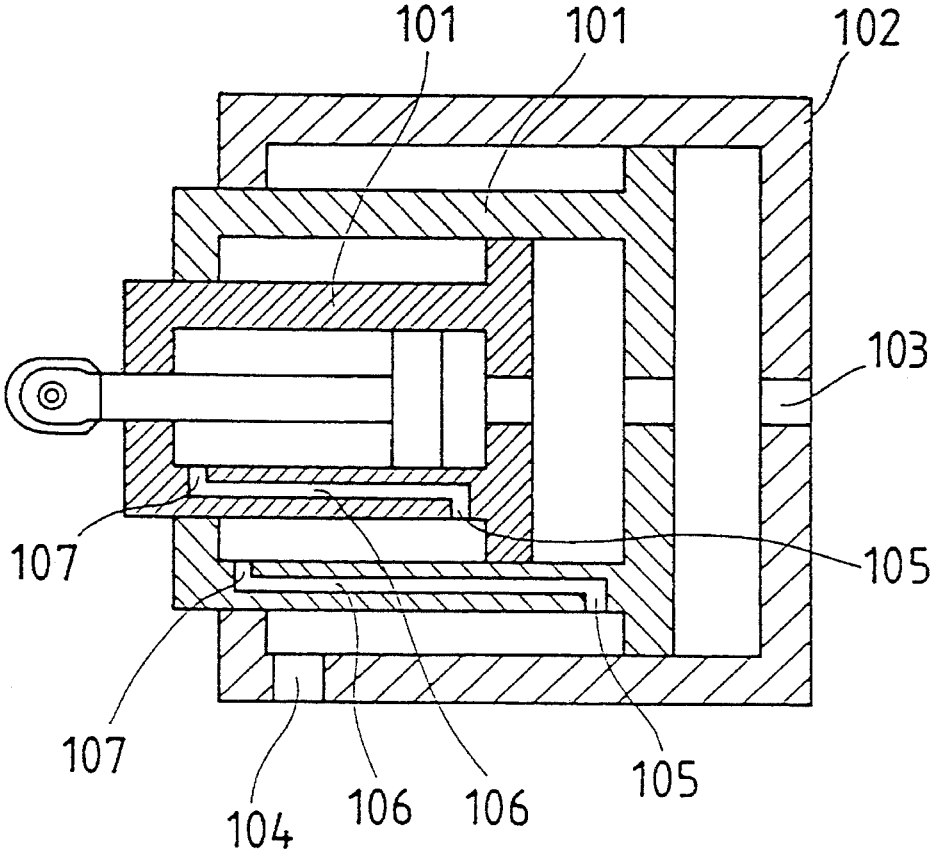
FIG. 4 illustrates a conventional telescopic hydraulic cylinder by way of example.

Although the second oil ports 10 are provided in the first cylinder bottoms 9 in the above embodiment, the second oil ports 10 may be provided in the vicinity of the first cylinder bottoms 9. FIG. 3 is a sectional view showing the principal part of a second embodiment, mainly the constituent parts differing from those of the first embodiment as the other parts are the same as the first embodiment and designated by the identical reference numerals. In the second embodiment, the second oil ports 10' are provided in the vicinity of the first cylinder bottoms 9 and open into the piston-rod-side chambers 14 of the second cylinders 3' and 3".

The fourth oil ports 16' also open into the piston-rod-side oil chambers **14*a* of the second cylinder 3' and 3" by way of the second cylinders 3' and 3" and the cylinder head 23. When the first cylinders 2 complete their forward strokes, the fourth oil ports 16' confront and communicate with the second oil ports 10', thereby defining passages with a predetermined flow resistance between the fourth oil ports 16' and the second oil ports 10'**.

In the second embodiment, the forward movements of the pistons 5 and the first cylinders 2 are the same as the first embodiments. In the case where the pistons 5 and the first cylinders 2 have reached their stroke ends and then are retracted, if the hydraulic oil is introduced through the fourth oil ports 16', it flows into the piston-rod-side oil chambers 6 of the first cylinders by way of the fourth oil ports 16', the second oil ports 10', the oil passages 11, and the first oil ports 8, thereby retracting the pistons 5 to open the arms 33. When the pistons 5 have reached their backward stroke ends, the pressure of the hydraulic oil is raised within the piston-rod-side oil chambers 6 of the first cylinders, the fourth oil ports 16', and the second oil ports 10', and the hydraulic oil is allowed to flow into the piston-rod-side oil chambers **14*a* of the second cylinders 3' and 3" by way of the gaps defined by the confronting surfaces of the fourth oil ports 16' and the second oil ports 26, to thereby initiate the backward movement of the first cylinder 2. Then, when the fourth oil ports 16' become disengaged from the second oil ports 10', the cylinder bottoms 9 of the first cylinders 1 directly undergo the pressure of the hydraulic oil introduced through the fourth oil ports 16', and the first cylinders 1 are retracted to open the arms 33**.

According to each of the above embodiments, although a double rod type telescopic hydraulic cylinder is used so that the clevises 13 on the extremities of the piston rods 4 can rotatably be joined to the arms 33 through the pins or the like, there may be employed a single rod type telescopic hydraulic cylinder. In order to do so, the second cylinder 3 of the embodiments may be cut in half substantially at the middle of its axial line. Each cut surface is provided with an integral cylinder bottom having an oil port through which hydraulic oil is supplied for the forward movement. One of the arms 33 of the crushing equipment may be rotatably joined with a pin or alternative means to the clevis 13 on the extremity of the piston rod 4, while the other of the arms 33 may be rotatably joined with a pin or alternative means to the cylinder bottom.

For the above embodiments, the description has been made on the constitution and operation of the two-stage type telescopic hydraulic cylinder 1 comprising a first cylinder 2 fitted into a second cylinder 3, but they may be a multi-stage type telescopic hydraulic cylinder comprising a first cylinder 2, second, third, . . . , and n-th cylinder, one being fitted into another sequentially in the mentioned order. In such a case, the second through the (n−1)th cylinders may have substantially the same constitution as that of the first cylinder 2 in the present embodiments, and the engaging relationship between the first cylinder 2 and the second cylinder 3 disclosed in these embodiments is applicable to the engaging portions of the adjacent cylinders from the second to the n-th cylinders. The n-th cylinder may have substantially the same constitution as that of the second cylinder 3 in the present embodiments.

What is claimed is:

1. An apparatus for crushing concrete structures, comprising a pair of arms having extremities, a pair of crushing blades fixedly secured to the respective extremities of said arms so as to confront each other, and a hydraulic cylinder unit for opening and closing the arms to crush the concrete structures by means of said crushing blades, wherein said hydraulic cylinder unit comprises:

a first cylinder having a bottom, which receives therein a piston having a piston rod protruding in one direction, said first cylinder including a piston-rod-side oil chamber and a piston-side oil chamber in front of and behind said piston, respectively; and a second cylinder which receives therein said first cylinder whose cylinder bottom serves as a piston of said second cylinder, said second cylinder including a piston-rod-side oil chamber and a piston-side oil chamber in front of and behind said cylinder bottom, respectively, of said first cylinder;

said first cylinder having a first oil port opening in said piston-rod-side oil chamber, a second oil port opening in the outer periphery of said cylinder bottom and communicating with said first oil port by way of an oil passage extending through the interior of said first cylinder, and a third oil port provided in said cylinder bottom;

said second cylinder having a fourth oil port opening in said piston rod-side oil chamber, and a fifth oil port opening in said second cylinder bottom;

a passage formed between said second oil port and said piston-rod-side oil chamber of said second cylinder for producing a predetermined flow resistance;

said fourth oil port communicating with said second oil port when said first cylinder reaches its stroke end on piston rod side.

2. An apparatus for crushing concrete structures comprising a pair of arms having extremities, a pair of crushing blades fixedly secured to the respective extremities of said arms so as to confront each other, and a hydraulic cylinder unit for opening and closing the arms to crush the concrete structures by means of said crushing blades, wherein said hydraulic cylinder unit comprises:

a couple of first cylinders each having a bottom and receiving therein a piston which has a piston rod protruding in one direction, each of said first cylinders including a piston-rod-side oil chamber and a piston-side oil chamber in front of and behind said piston, respectively; and a couple of second cylinders each receiving therein a first cylinder whose cylinder bottom serves as a piston of a second cylinder, each of said second cylinders including a piston-rod-side oil chamber and a piston-side oil chamber in front of and behind said cylinder bottom, respectively, of said first cylinder;

each of said first cylinders having a first oil port opening in a piston-rod side oil chamber, a second oil port opening in the outer periphery of said cylinder bottom and communicating with said first oil port by way of an oil passage extending through the interior of a first cylinder, and a third oil port opening in said cylinder bottom;

each of said second cylinders having a fourth oil port opening a piston-rod-side oil chamber, and a fifth oil port opening in said second cylinder bottom;

a passage formed between said second oil port and said piston-rod-side oil chamber of each second cylinder for producing a predetermined flow resistance;

said fourth oil port communicating with said second oil port when a first cylinder reaches its stroke end on piston rod side;

said couple of first cylinders and said couple of second cylinders being provided in pairs, respectively, each pair consisting of said first cylinder and said second cylinder;

said couple of second cylinders being bottom-to-bottom joined together through an annular member so as to define said piston side-oil chamber in each of said second cylinders.

3. An apparatus for crushing concrete structures, comprising a pair of arms having extremities, a pair of crushing blades fixedly secured to the respective extremities of said arms so as to confront each other, and a hydraulic cylinder unit for opening and closing the arms to crush the concrete structures by means of said crushing blades, wherein said hydraulic cylinder unit comprises:

a first cylinder having a bottom, which receives therein a piston having a piston rod protruding in one direction, said first cylinder including a piston-rod-side oil chamber and a piston-side oil chamber in front of and behind said piston, respectively; and a second cylinder which receives therein said first cylinder whose cylinder bottom serves as a piston of said second cylinder, said second cylinder including a piston-rod-side oil chamber and a piston-side oil chamber in front of and behind said cylinder bottom, respectively, of said first cylinder;

said first cylinder having a first oil port opening in a piston-rode-side oil chamber, a second oil port opening in the vicinity of said cylinder bottom and also into said piston-rod-side oil chamber and communicating with said first oil port by way of an oil passage extending through the interior of said first cylinder, and a third oil port provided in said cylinder bottom;

said second cylinder having a fourth oil port opening in said piston-rod-side oil chamber, and a fifth oil port provided in said second cylinder bottom;

said fourth oil port communicating with said second oil port when said first cylinder reaches its stroke end on piston rode side to define a passage having a predetermined flow resistance between said fourth oil port and said piston-rod side oil chamber of the second cylinder.

4. An apparatus for crushing concrete structures, comprising a pair of arms having extremities, a pair of crushing blades fixedly secured to the respective extremities of said arms so as to confront each other, and a hydraulic cylinder unit for opening and closing the arms to crush the concrete structures by means of said crushing blades, wherein said hydraulic cylinder unit comprises:

a couple of first cylinders each having a bottom receiving therein a piston with a piston rod protruding in one direction, each of said first cylinders including a piston-rod-side oil chamber and a piston-side oil chamber in front of and behind said piston, respectively; and a couple of second cylinders each receiving therein a first cylinder whose cylinder bottom serves as a piston of said second cylinder, each of said second cylinders including a piston-rod-side oil chamber and a piston-side oil chamber in front of and behind said cylinder bottom, respectively, of a first cylinder;

each of said first cylinders having a first oil port opening in a piston rod-side oil chamber, a second oil port opening in the outer periphery of said cylinder bottom and communicating with said first oil port by way of an oil passage extending through the interior of a first cylinder, and a third oil port provided in said cylinder bottom;

each of said second cylinders having a fourth oil port opening in a piston rod-side oil chamber, and a fifth oil port provided in said second cylinder bottom;

said fourth oil port communicating with said second oil port when a first cylinder reaches its stroke end on piston rod side to define a passage having a predetermined flow resistance between said fourth oil port and said piston-rod side oil chamber of each second cylinder;

said couple of first cylinders and said couple of second cylinders being provided in pairs, respectively, each pair consisting of said first cylinder and said second cylinder;

said couple of second cylinders being bottom-to-bottom joined together through an annular member so as to define said piston-side-oil chamber in each of said second cylinders.

* * * * *